US005109754A

United States Patent [19]

Shaw

[11] Patent Number: 5,109,754

[45] Date of Patent: May 5, 1992

[54] HIGH TORQUE LOW SPEED MOTOR

[76] Inventor: Edwin L. Shaw, P.O. Box 745, Captain Cook, Hi. 96704

[21] Appl. No.: 799,324

[22] Filed: Nov. 27, 1991

Related U.S. Application Data

[62] Division of Ser. No. 538,073, Jun. 13, 1990, Pat. No. 5,094,147.

[51] Int. Cl.[5] ..... F01B 3/00; F04B 1/12

[52] U.S. Cl. ..... 91/499; 417/269

[58] Field of Search ..... 91/499, 500, 501, 502, 91/503; 417/269

[56] References Cited

U.S. PATENT DOCUMENTS

| | | | |
|---|---|---|---|
| 432,359 | 7/1890 | Berry | 91/499 |
| 2,096,907 | 10/1937 | Linderman | 91/500 |
| 2,364,301 | 12/1944 | MacNeil | 91/500 |
| 2,661,700 | 12/1953 | Towler | 417/269 |
| 3,196,698 | 7/1965 | Liddington | 91/501 |
| 3,228,303 | 1/1966 | Budzich | 91/499 |
| 3,602,105 | 8/1971 | Slusher | 91/501 |
| 4,301,716 | 11/1981 | Saegusa et al. | 417/269 |
| 4,444,549 | 4/1984 | Takahashi et al. | 417/269 |
| 4,701,109 | 10/1987 | Daikowara | 417/269 |
| 4,784,045 | 11/1988 | Terauchi | 417/269 |
| 4,869,651 | 9/1989 | Smimizu et al. | 417/269 |
| 4,893,993 | 1/1990 | Smimizu | 417/269 |

*Primary Examiner*—Richard A. Bertsch
*Assistant Examiner*—Peter Korytnyk
*Attorney, Agent, or Firm*—Thomas S. Baker, Jr.

[57] ABSTRACT

A high torque low speed motor has a nutating assembly driven by a hydraulic or an electric actuator. The nutator assembly drivingly connects to an output shaft through a gear train. Because of a difference in the number of teeth between a gear on the output shaft and a gear on the nutating assembly, the output shaft is driven at a differential ratio as the nutator assembly is driven.

8 Claims, 5 Drawing Sheets

HIGH TORQUE LOW SPEED MOTOR

This application is a division of patent application Ser. No. 07/538,073 filed Jun. 13, 1990 now U.S. Pat. No. 5,094,147.

Conventional high torque low speed motors most often are fluid motors utilized to drive industrial equipment having high torque demands such as drilling rigs, mining equipment and some construction equipment. Such motors may be divided into two general categories. The first category may be entitled direct drive machines in which the fluid actuators such as fluid driven pistons act directly on a crank shaft or on a multi-lobed cam which in turn is connected to an output shaft. Generally, these units have a small number of large displacement pistons and cylinder assemblies. The pistons of such assemblies act directly on a crank shaft or equivalent member. Those units having a larger number of smaller displacement cylinders have the pistons or plungers act on multi-lobed cams which are attached internally to and rotate with the output shaft. These devices have smooth and controllable speed outputs.

The second category of machines may be defined as geared drive devices. These machines have a fluid motor driving into a speed reducing gear box to obtain a high torque output. In such devices the fluid motor operates at a relatively high speed whereas the output of the gear box has a relatively low speed.

The aforementioned categories of high torque low speed motors have some disadvantages. In most instances the direct drive type of machines are relatively large and heavy. Unfortunately, because of the size of the units, because of the high fluid pressure losses which occur from high fluid flow rates in the internal passages of the motor and because of the problem of balancing the mass of the heavy reciprocating parts, the output speed is limited to approximately 300 revolutions per minute. Additionally, these units experience some loss of torque as the speed of the units increases due to the pressure losses which occur from the high flow rates.

The geared drive type of machines are smaller and lighter than the direct drive type of devices, but the units must have higher rotational speeds to provide an equivalent torque output. The higher operating speeds involved cause motor inertia to become a problem when the unit must be stopped. Sudden stopping of the motor by operation of a system control valve can cause cavitation and pressure spikes to occur within the motor which can cause severe damage to the device. This condition becomes aggravated when the system control valve is close coupled to the motor to obtain improved system response and stiffness. In addition it has been found that sudden stopping of the output shaft may cause gears to strip and shafts to break in the gear reduction unit at high rotational operating speeds since the reflected motor inertia increases by a factor equal to the square of the gear ratio.

Accordingly, it is desirable to provide a small, high torque low speed motor having a relatively small amount of motor inertia through all speed ranges of the device to thereby prevent failure of components during operation of the machine at high speeds.

SUMMARY OF THE INVENTION

The instant invention provides a high torque fluid motor having a housing with a plurality of cylinder bores formed therein. A first bevel gear having a set of teeth is mounted in the housing. A nutator assembly is pivotally mounted on a pivot means within the housing. The nutator assembly has a first set of teeth adapted to engage the teeth on the first bevel gear and a second set of angle gear teeth. An output shaft is mounted within the housing having a shaft gear mounted at one end thereof. The angle gear teeth on the nutator assembly engage the teeth of the shaft gear. The number of angle gear teeth on the nutator assembly is unequal to the number of teeth of the shaft gear. Pistons are mounted within the cylinder bores and have pivotally mounted shoes rigidly affixed to the nutator assembly. A fluid inlet port and a fluid exhaust port are formed within the housing. A valve means directs fluid from the inlet port to the cylinder bores and from the cylinder bores to the outlet port to sequentially cause the pistons to be extended from the housing to thereby cause the nutator assembly to nutate about the pivot means such that the shaft gear and the output shaft are rotated.

DESCRIPTION OF THE PREFERRED EMBODIMENT

Figure 1:
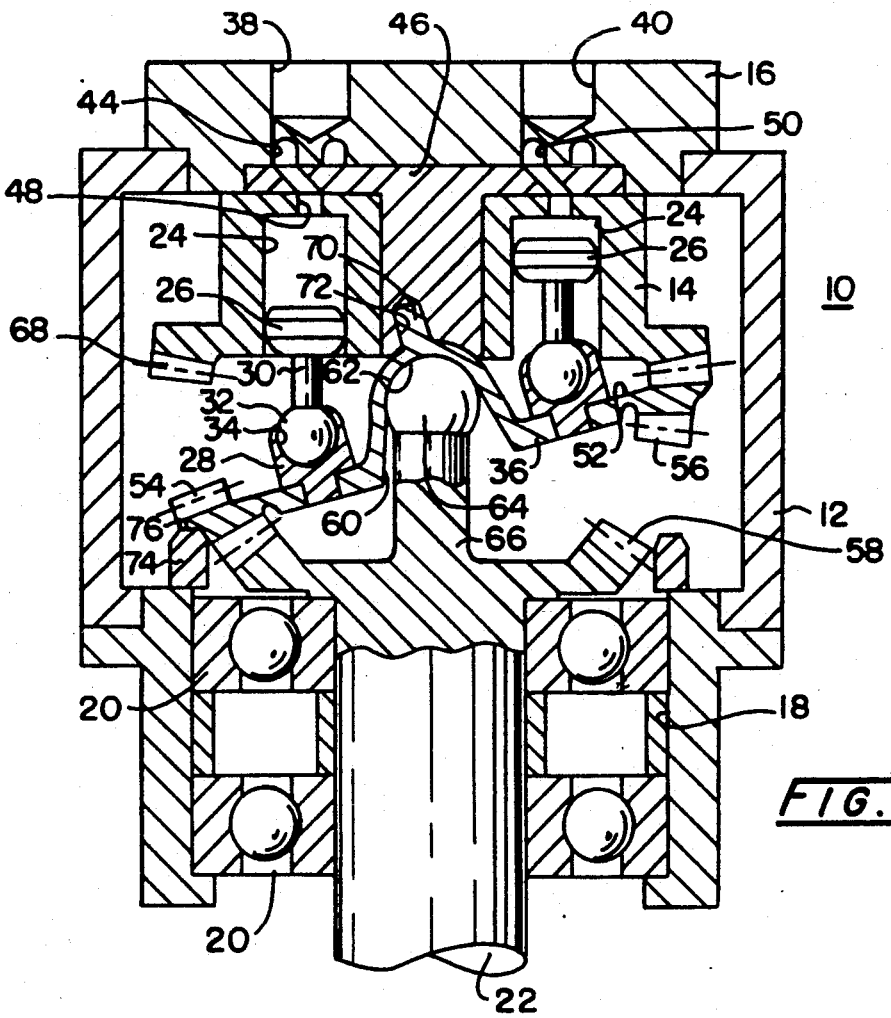
FIG. 1 is a cross sectional view of the preferred embodiment of the high torque motor of the present invention.

The subject invention provides a small high torque low speed motor having few parts and a relatively small rotating mass. The motor may be driven by a fluid motor (air or hydraulic) or electrically powered actuators as will be described hereinafter. The preferred embodiment of the high torque low speed motor of the present invention may be seen by referring to FIG. 1 where the motor has been indicated generally by the numeral 10. Motor (10) includes a housing (12) having a fixed cylindrically shaped cylinder block or barrel (14), a port block (16) at one end and an internal bore (18) adapted to receive bearings (20) for rotatably supporting an output shaft (22) at the other end. Cylinder block (14) contains five cylindrical bores (24) each containing a piston (26) which may be seen also by referring to FIG. 3. Turning again to FIG. 1, each of the pistons (26) is connected to a rotatable shoe (28) through a connecting rod (30) having a ball (32) at one end thereof received in a shoe socket (34). The shoes are rigidly affixed to a nutator assembly (36) which will be described in detail hereinbelow. Hydraulic pressure fluid drives the pistons as will now be described.

A source of pressurized fluid, not shown, is directed to a pressure port (38) contained within the port block (16). Port block (16) also contains an exhaust port (40). The pressurized fluid flows from the pressure port (38) through a kidney shaped supply ring (44) formed in a rotatable valve plate (46) which in turn opens into a cylinder port (48) at the entrance to the piston bores (24). Valve plate (46) also contains an exhaust port (50) which may be seen by referring to FIG. 2. Turning again to FIG. 1, it may be observed that rotatable valve plate (46) has a T shape wherein the thin head portion of the T shape containing semi-circular ports (40 and 50) resides between the stationary port block (16) and the stationary barrel (14) and the central cylindrical base portion extends through the center of cylinder block (14). When pressure fluid is supplied to pressure port (38) to drive the motor (10) as will be described hereinbelow, the valve plate (46) rotates to sequentially supply pressure fluid to the cylinder bores (24) to force the pistons (26) downwardly and to connect the bores (24) having spent fluid to the exhaust port (50) when the pistons (26) are driven upwardly within the cylinders.

The nutator assembly (36) has a reaction surface (52), an upwardly facing bevel gear (54) having a first set of teeth and a downwardly facing angle gear (56) having a second set of teeth. Output shaft (22) includes a shaft gear (58) which meshes with the angle gear (56) on nutator assembly (36). Nutator assembly (36) includes a recessed center section (60) with a rounded bottom section (62) mounted on a ball shaped pivot (64) which projects from an extended cylindrical end member (66) of output shaft (22). The upwardly facing bevel gear (54) on nutator assembly (36) engages a bevel gear (68) rigidly affixed to barrel member (14). Preferably, fixed bevel gear (68) and bevel gear (54) on nutator assembly (36) have the same number of teeth. In the preferred embodiment of this invention the angle gear (56) on nutator assembly (36) has a greater diameter and contains a greater number of teeth than the number of teeth of shaft gear (58). When pressure fluid is supplied to the device (10), nutator assembly (36) nutates around spherical pivot (64). Because fixed bevel gear (68) contains the same number of teeth as nutating bevel gear (54) the nutator assembly (36) cannot rotate—it can only nutate. As assembly (36) nutates, angle gear (56) engages all of the teeth on shaft gear (58). During one nutation of the nutator assembly, the output shaft (22) is caused to rotate an angular amount equal to the difference in the number of teeth between those on angle gear (56) and those on shaft gear (58). In other words, angle gear (56) forces shaft gear (58) to rotate a distance equal to the difference in the number of teeth on the two gears.

Figure 3:
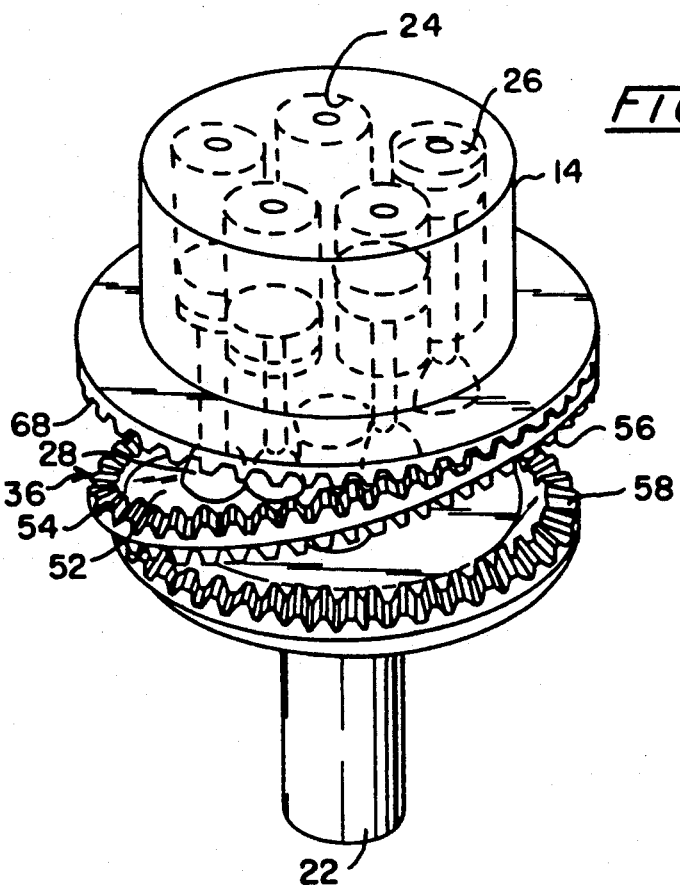
FIG. 3 is a schematic representation of the gears in the embodiment illustrated in FIG. 1.

The relationship of the bevel gears (54 and 68) and of the angle gear (56) and shaft gear (58) may be seen in more detail by referring to the schematic representation of the gear train illustrated in FIG. 3. It may be seen that the fixed bevel gear (68) attaches rigidly to the outer surface of cylinder block (14) and faces downwardly. The nutator assembly (36) includes the reaction surface (52) which faces and receives the shoes (28) attached to pistons (26) and has bevel gear (54) which faces upwardly and engages the oppositely directed fixed bevel gear (68). Also, the angle gear (56) projects downwardly from the nutator assembly (36) in a direction opposite of that of bevel gear (54) and engages the teeth formed on shaft gear (58) connected to output shaft (22). As mentioned above, nutating motion of nutator assembly (36) causes shaft gear (58) to rotate by the differential number of teeth between the angle gear (56) and shaft gear (58) and to thereby drive output shaft (22).

Figure 2:
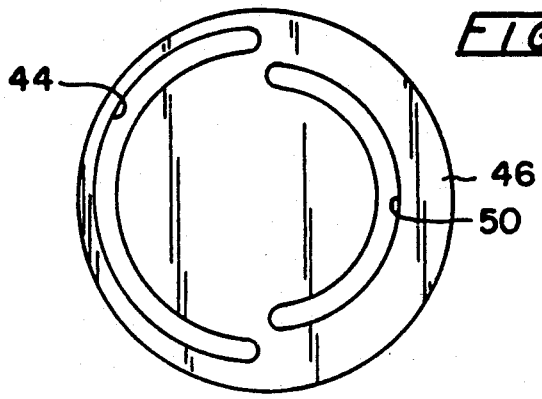
FIG. 2 represents a view of the inlet and exhaust ports formed in the port plate.

Operation of the preferred embodiment of the high torque low speed motor (10) of the present invention now will be described. Turning again to FIG. 1, hydraulic pressure fluid is supplied to the pressure port (38) of port block (16). This pressure fluid passes through the semi-circular kidney shaped supply ring (44) in valve plate (46) and sequentially centers the cylinder bores (24) through the cylinder ports (48). The pressure fluid in each bore (24) acts on the piston (26) to force the piston and shoe assembly downwardly as viewed in FIG. 1. This causes nutator assembly (36) to rock across the spherical pivot (64). When one side of nutator assembly (36) rocks downwardly the other side lifts up and the cylinders (24) of the pistons (26) moving upwardly are connected to the exhaust ring (50) in valve plate (46) and to exhaust port (40). As the nutator assembly (36) nutates about the ball shaped pivot (64), a lug (70) on assembly (36) in a bore (72) in valve plate (46) causes the valve plate (46) to rotate to thereby connect the supply ring (44) and the exhaust ring (50) sequentially to the pistons (26) to maintain the nutating action of the assembly (36). It should be noted that the valve plate (46) as illustrated in FIG. 1 actually is shown approximately 90 degrees out of phase inasmuch as the cylinder bore (24) having the piston (26) in the maximum downwardly position would be at a crossover point on the valve plate (46) from the supply ring (44) to the exhaust ring (50). Additionally, the right hand cylinder (24) containing piston (26) at the uppermost portion of its stroke would be at the crossover portion of valve plate (46) from the exhaust ring (50) to the supply ring (44). These crossover points are approximately at the twelve o'clock and six o'clock positions as viewed in FIG. 2. As the nutator assembly (36) nutates around the ball shaped pivot (64) the bevel gears (54 and 68) remain in mesh which prevents the nutating angle gear (54) from rotating. During one complete nutation of assembly (36) angle gear (56) engages a number of teeth on shaft gear (58) equal to the number of teeth on angle gear (56). Because angle gear (56) has a greater number of teeth than shaft gear (58) the shaft gear will be forced to rotate by an amount equal to the difference in the number of teeth of the two gears. Although, in the preferred embodiment of the invention the fixed and nutating bevel gear (68 and 54) have an equal number of teeth to prevent rotation of the nutator assembly (36), slightly changing the number of teeth between these gears would enable one to alter the final output drive ratio of output shaft (22) if it were desired.

Referring again to FIG. 1, it may be observed that a circular thrust ring (74) is mounted within the housing (12). This ring engages a thrust surface (76) formed on nutator assembly (36) to limit the angle of nutation of that assembly. This ring (74) also reduces the load on shaft gear (58) imposed by angle gear (56).

It has been found desirable to allow the output shaft (22) to freewheel with respect to the driving mechanism under certain conditions. The preferred embodiment of the high torque low speed motor (10) of the present invention does not permit such freewheeling inasmuch as the shoes (28) of the drive pistons (26) are rigidly affixed to the nutator assembly (36) which in turn is drivingly connected to the output shaft (22) through angle gear (56) and shaft gear (58). A modification to the drive mechanism and to the connection between the valve plate and the nutator assembly (36) may be made which will enable the output shaft (22) to freewheel with respect to the hydraulic piston type drive mechanism. The required modifications may be seen be referring to FIG. 7 where this embodiment of the high torque low speed motor of the present invention bears the numeral 80. Those components identical to the components depicted in the preferred embodiment of FIG. 1 will be identified by identical primed numbers whereas those components which are different will be identified by different numbers.

Figure 7:
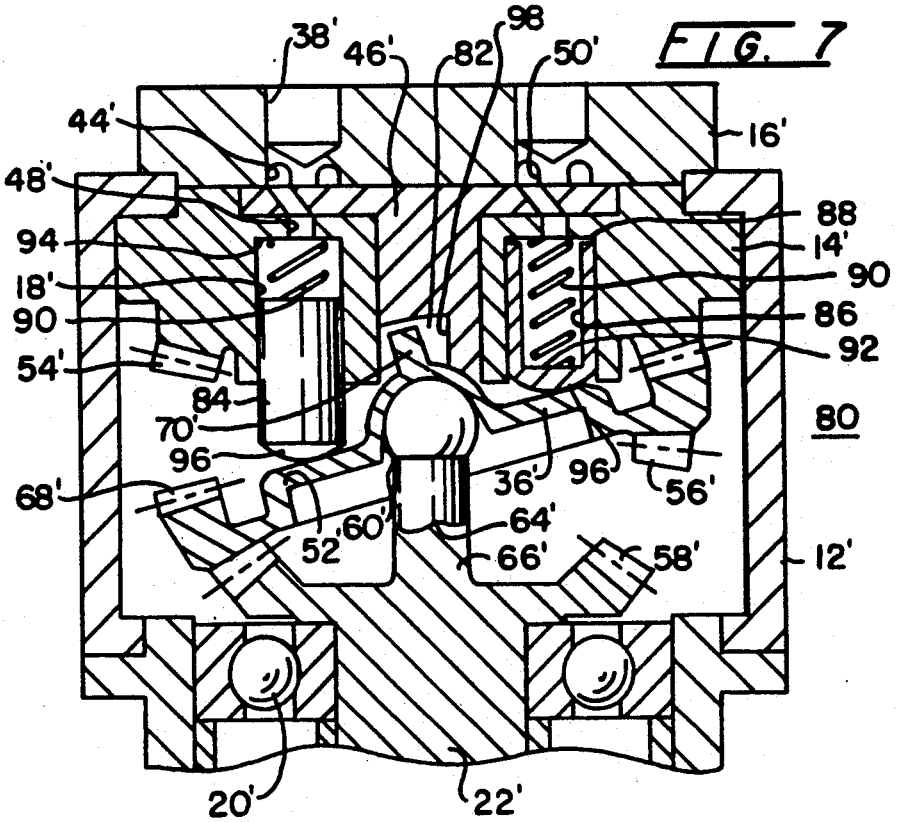
FIG. 7 is a third embodiment of the high torque low speed motor of the present invention having means to enable the output shaft to freewheel with respect to the motor actuators.

Turning to FIG. 7, it may be observed that the freewheeling high torque low speed motor (80) includes a housing (12'), a stationary barrel (14'), a port block (16') and a rotatable valve plate (46') interposed between the fixed cylinder block (14') and port block (16'). A plurality of internal bores (18') are formed within barrel (14') and a downwardly facing bevel gear (54') is affixed to the end of cylinder block (14').

Nutator assembly (36') includes an upwardly facing bevel gear (68') and a generally downwardly directed angle gear (56'). Angle gear (56') engages a shaft gear (58') mounted at one end of output shaft (22'). Furthermore, it may be seen that the nutator assembly (36') has a recessed center section (60') pivotally mounted on a spherical pivot (64') mounted on the extended cylindrical end (66') of output shaft (22'). Up to this point it may be observed that the primary components of the freewheeling high torque low speed motor (80) are substantially identical to those of the non-freewheeling high torque low speed motor (10) depicted in the preferred embodiment seen in FIG. 1. The freewheeling high torque low speed motor (80) has two important differences from that of the preferred embodiment. The first difference may be found in the driving connection between the nutator assembly (36') and the rotating valve plate (46'). In this embodiment the lug (70') occupies a slot (82) in the valve plate (46'). With this drive arrangement, it is possible for the nutator assembly (36') to pivot about the spherical pivot (64') to a horizontal position to a horizontal position to cause bevel gear (68') to disengage the fixed bevel gear (54') and angle gear (56) to disengage the shaft gear (58). Nutator assembly (36') will assume a horizontal position when the hydraulic actuators acting upon reaction surface (52') exert equal forces thereon.

Although cylinder block (14') contains the same series of conventional internal bores (18') as in the preferred embodiment, it does not contain the conventional pistons having connecting rods and shoes found in that embodiment. Instead, a plunger (84) having a central bore (86) and an opened end (88) resides within each of the internal bores (18'). Additionally, a spring (90) acts between the bottom surface (92) defining bore (86) and the wall (94) defining one end of internal bore (18') to bias the plungers (84) downwardly against the reaction surface (52') of nutator assembly (36'). It should be observed that each plunger (84) has a rounded outer surface (96) which engages reaction surface (52') of the nutator assembly (36'). However,.the plungers (84) are not mechanically connected to the nutator assembly (36'). Thus, when no pressurized hydraulic fluid is being supplied to the pressure port (38') of valve block (16') and the fluid motor is not operating, the springs (90) bias the plungers (84) into contact with the reaction surface (52') and exert equal forces on that surface to thereby cause the nutator assembly (36') to pivot to a position in which the reaction surface (52') lies in a horizontal plane as viewed in FIG. 7. Assembly (36') may assume this position inasmuch as lug (70') can pivot laterally within the slot (82) such that the inner side (98) of lug (70') engages the vertical inner wall (98) of valve plate (46'). When nutator assembly (36') assumes this horizontal position, bevel gear (68') disengages the fixed bevel gear (54') on cylinder block (14') and the angle gear (56) is disengaged from the shaft gear (58). Nutator assembly (36') is not connected and shaft (22) can freely rotate i.e., freewheel. Typically, freewheeling is desirable for pay out on a crane line or to reduce heat and power by disconnecting wheel drives on four wheel drive vehicles, or other similar purposes.

In operation, the high torque low speed motor (80) operates in the same manner as the motor (10) depicted in the preferred embodiment illustrated in FIG. 1. Hydraulic fluid under pressure is supplied to pressure port (38) which flows through supply ring (44) and on into the cylinder bores (18') sequentially to cause the plungers (84) to sequentially engage reaction surface (52') of nutator assembly (36'). When this occurs, the forces on the reaction surface (52') are unbalanced inasmuch as the pressure fluid causes the plungers (84) to extend from the bores (18') which forces the angle gear (56') into contact with the shaft gear (58') and the bevel gear (68') into mesh with the fixed bevel gear (54'). When the nutator assembly (36') pivots in response to the application of pressure fluid to pressure port (38'), lug (70') drives the valve plate (46'), nutator assembly (36') nutates about pivot (64') and shaft gear (58') and output shaft (22') are rotated in the same manner as in the non-freewheeling device (10) depicted in FIG. 1.

Figure 9:
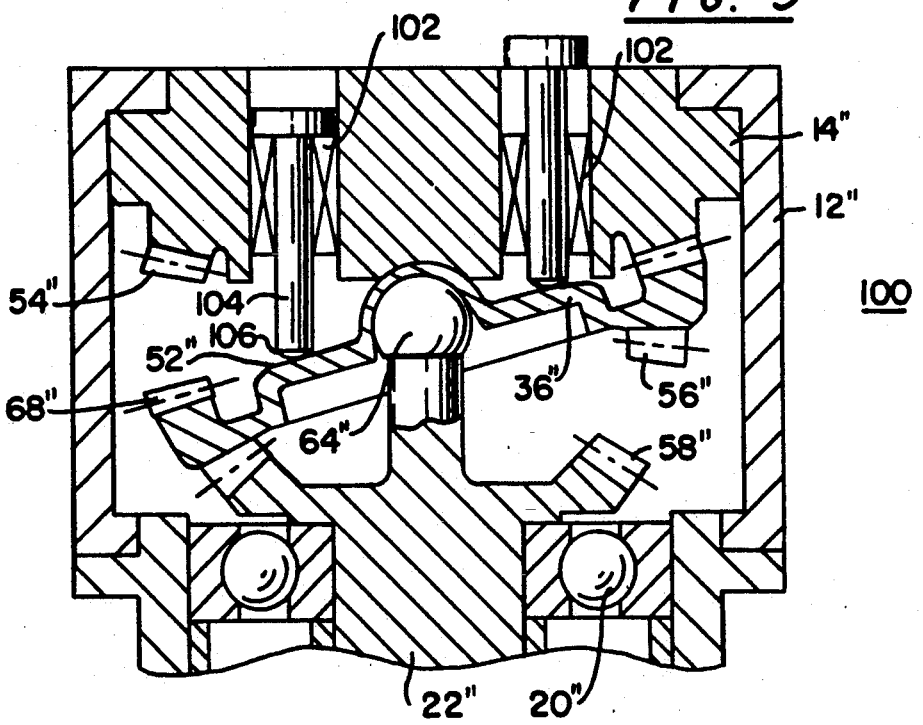
FIG. 9 is a sectional view of a high torque low speed motor operated by a plurality of solenoid type actuators.

Both the non-freewheeling high torque low speed motor (10) and the freewheeling high torque low speed motor (80) described above utilized a hydraulic motor to drive the nutator assemblies (36 and 36'). However, the high torque low speed motor of the present invention also may be driven by electrically operated actuators as illustrated in FIG. 9 where the high torque low speed device has been given the numeral 100. The description of this embodiment of the invention will use double primed numbers with respect to those elements which are identical to those of the preferred embodiment in FIG. 1 and new numbers for those elements which are not identical. The electrically operated device (100) includes a housing (12") having a fixed barrel (14") with a downwardly facing bevel gear (54") rigidly affixed thereto. The high torque low speed motor (100) of this embodiment also includes a conventional nutator assembly (36") having an upwardly facing bevel gear (68") adapted to mesh with fixed bevel gear (54") and a downwardly facing angle gear (56"). An output shaft (22") is rotatably mounted in bearings (20") mounted within housing (12"). An upwardly facing shaft gear (58") is rigidly affixed to output shaft (22") and meshes with angle gear (56"). Additionally, output shaft (22") mounts a spherical pivot (64") which pivotally supports the nutator assembly (36") in the same manner as described in connection with the previous two embodiments. Nutator assembly (36") also includes an upwardly facing reaction surface (52") as viewed in FIG. 9. Although not illustrated, a thrust ring may be mounted in housing (12") to limit the nutating motion of the assembly (36"). However, in normal applications the thrust ring would not be necessary. In the electrically operated high torque low speed motor (100), a plurality of equally spaced, circumferentially arranged solenoids (102) sequentially operate plungers (104) having rounded outer ends (106) which engage the reaction surface (52") on nutator assembly (36") to cause the assembly to nutate and shaft gear (58") and output shaft (22") to rotate in the same manner as described in the previous two embodiments. Preferably, the solenoids (102) are computer controlled to sequentially bias the plungers (104) against the reaction surface (52") to control the nutating movement of the nutator assembly (36").

In the high torque low speed motors (10 and 80) driven by pressure fluid, the torque load output of the motor is directly proportional to the difference in fluid pressure at the pressure port and the exhaust port, the displacement of the pistons, the differential ratio of the angle gear and shaft gear and the mechanical efficiency of the overall devices. In the electrically operated high torque low speed motor (100) the torque load output of the device is a function of the force output by the solenoids (102), the differential ratio of the angle gear (56) and the shaft gear (58) and the mechanical efficiency of the unit. It may be appreciated that the computer controlled solenoids (102) provide a precise control of the speed of the nutator assembly (36"). They also control the direction of rotation of the device depending upon the sequence of operation thereof. Additionally, it has been found that ratios ranging from 5 to 1 to 30 to 1 easily may be obtained by the differential action of the nutator angle gear (56) and the output shaft gear (58) for the aforementioned devices.

Figure 4:
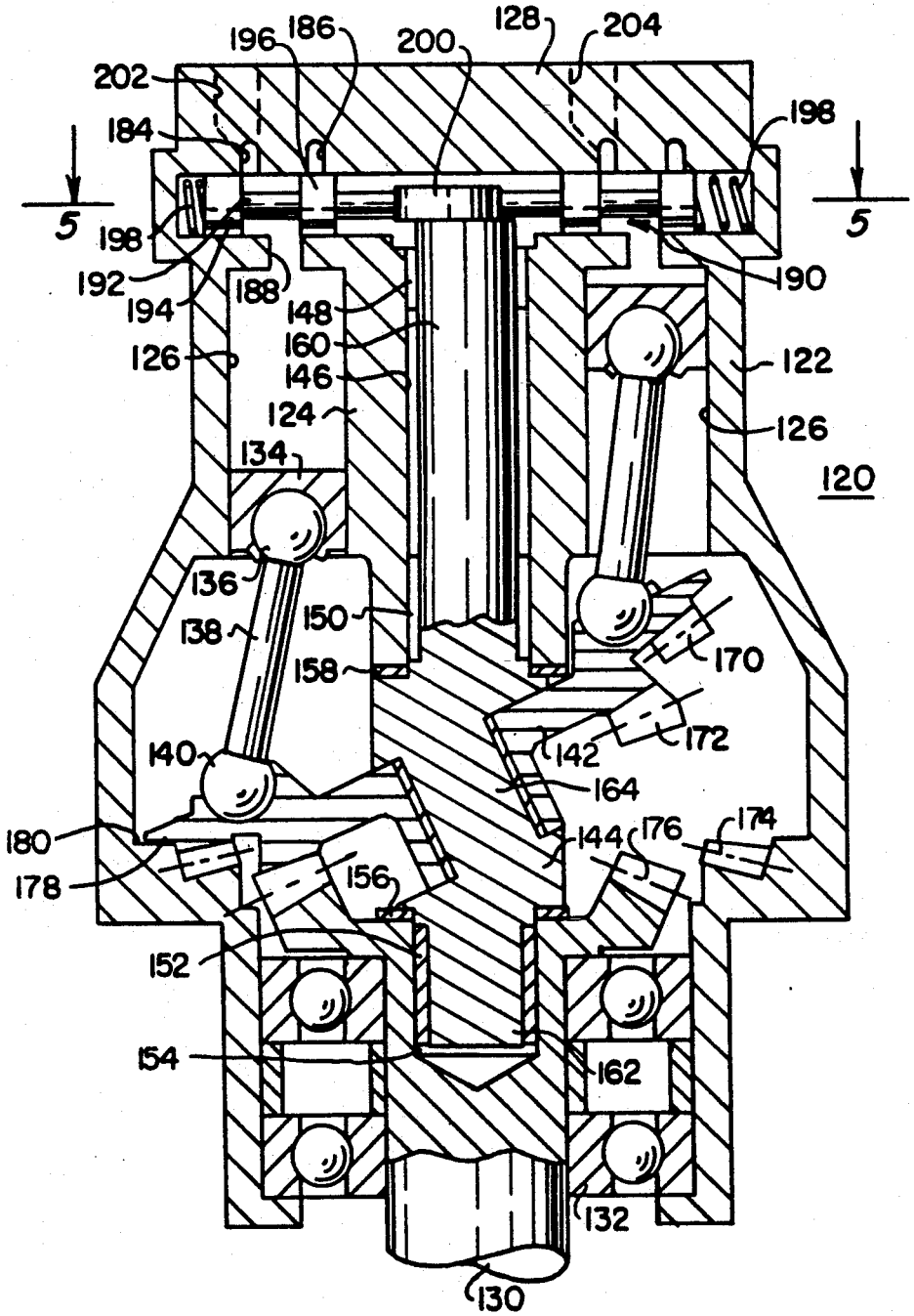
FIG. 4 is a cross sectional view of the second embodiment of the high torque low speed motor of the present invention.

An alternate embodiment of a high torque low speed motor utilizing a pair of bevel gears to prevent rotation of a nutator assembly and a nutator assembly having an angle gear which meshes with a shaft gear to rotate the shaft gear and an output shaft may be seen by referring to FIG. 4 where the device has been identified by the number (120).

Although this embodiment depicts the use of a hydraulic drive for the device (120), it should be understood that the device could be powered by pneumatic or electrical actuators as well. The high torque low speed motor (120) includes a housing (122) having a fixed cylinder block assembly (124) with a plurality of axially aligned circumferentially spaced bores (126) and a port block (128) at one end. An output shaft (130) is mounted in a set of bearings (132) at the end opposite the port block (128). Each bore (126) contains a piston (134) pivotally connected to a spherical head (136) on one end of a connecting rod (138). The opposite end of the connecting rod (138) mounts a second spherical head (140) pivotally connected to a nutator assembly (142). Five piston and rod assemblies (134 and 138) are shown and are utilized to drive the nutator assembly (142). However; three, seven, nine or more assemblies also may be used. An even number of assemblies may be used, but torque ripple may result.

In this embodiment of a high torque low speed motor, the nutator assembly (142) is mounted on an angle or zeed shaft (144). Cylinder block assembly (124) contains a longitudinal central bore (146) containing bearings (148 and 150) which rotatably mount one end of shaft (144). Shaft (144) also is received within a bearing (152) mounted in a bore (154) formed in one end of output shaft (130). A thrust bearing (156) is interposed between angle shaft (144) and the end of output shaft (130) and a similar thrust bearing (158) is interposed between a lateral surface on angle shaft (144) and the end of barrel assembly (124). It may be seen that the angle shaft (144) has two concentric straight sections (160 and 162) connected rigidly by a central offset section (164) which mounts nutator assembly (142). Assembly (142) is rotatably mounted about section (164). For ease of assembly, the angle shaft (144) should be constructed of two machined pieces connected together after nutator assembly (142) has been mounted on the offset section (164).

Nutator assembly (142) rigidly mounts a downwardly facing bevel gear (170) and a concentric downwardly facing angle gear (172) having a smaller diameter than that of bevel gear (170). Bevel gear (170) meshes with a fixed bevel gear (174) rigidly mounted in housing (122) whereas angle gear (172) meshes with a shaft gear (176) rigidly affixed to the end of output shaft (130). Nutator assembly (142) has a circular thrust surface (178) outboard of angle gear (170) which engages a complementary thrust surface (180) formed within housing (122) to limit the squeezing or crushing force bevel gear (170) may inflict upon bevel gear (174) and a similar force which angle gear (172) may inflict upon shaft gear (176).

Nutator assembly (142) nutates about angle shaft (144) when pressurized fluid is sequentially supplied to the cylinder bores (126) to drive the piston and connecting rod assemblies (134 and 138) downwardly in the bores and spent fluid within the bores (126) is exhausted therefrom. During nutation of assembly (142) bevel gear (170) remains in engagement with the fixed bevel gear (174) to prevent rotation of the nutator assembly (142) and angle gear (172) drives shaft gear (176) which rotates angularly an amount equal to the difference in the number of teeth between the angle gear (172) and the shaft gear (176). Again, preferably angle gear (172) contains more teeth than does shaft gear (176). Additionally, it is preferred to make bevel gear (170) with the same number of teeth as bevel gear (174) to prevent rotation of the nutator assembly (142). This becomes essential where the piston and connecting rod assemblies (134 and 138) are connected rigidly to the assembly (142) as in FIG. 4. If these assemblies were not rigidly connected to the nutator assembly (142) and it would be possible for the bevel gears (170 and 174) to have different numbers of teeth to provide a particular differential ratio for the device (120).

The high torque low speed motor (120) depicted in FIG. 4 operates in the same manner as does the high torque low speed motor (10) of the preferred embodiment depicted in FIG. 1. The main difference between the two assemblies resides in the mounting means for the nutator assembly (142) and the use of connecting rods (138) which are pivotally connected between the pistons (134) and the nutator assembly (142). Additionally, a different type of valve assembly is utilized to supply and exhaust pressure fluid from the cylinder bores (126). This assembly now will be described by referring to FIG. 4 and also to FIG. 5.

Figure 5:
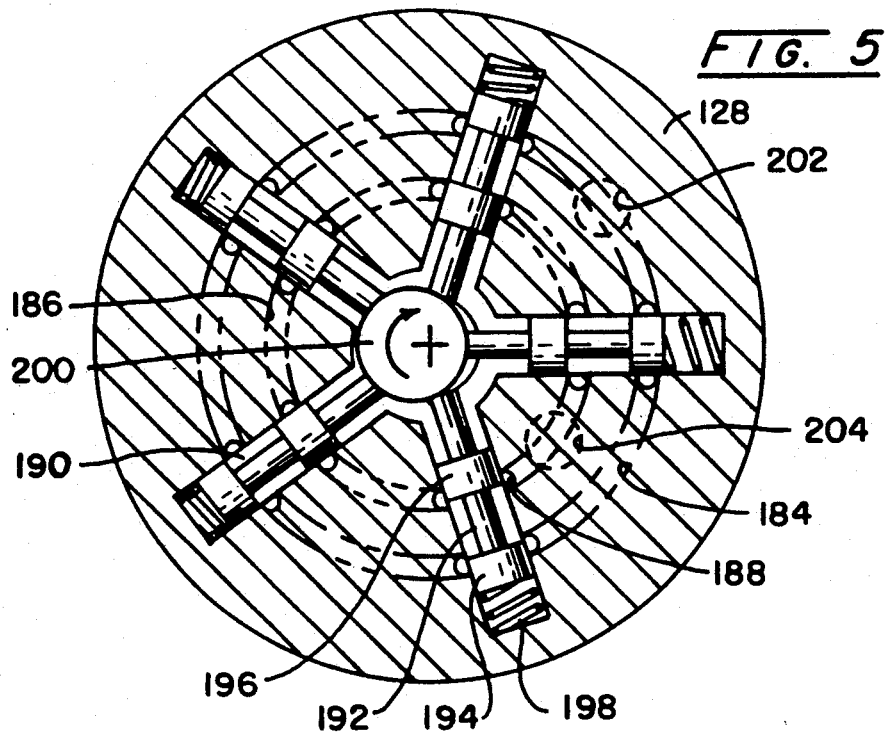
FIG. 5 is a view along line 5—5 of FIG. 4.
Figure 6:
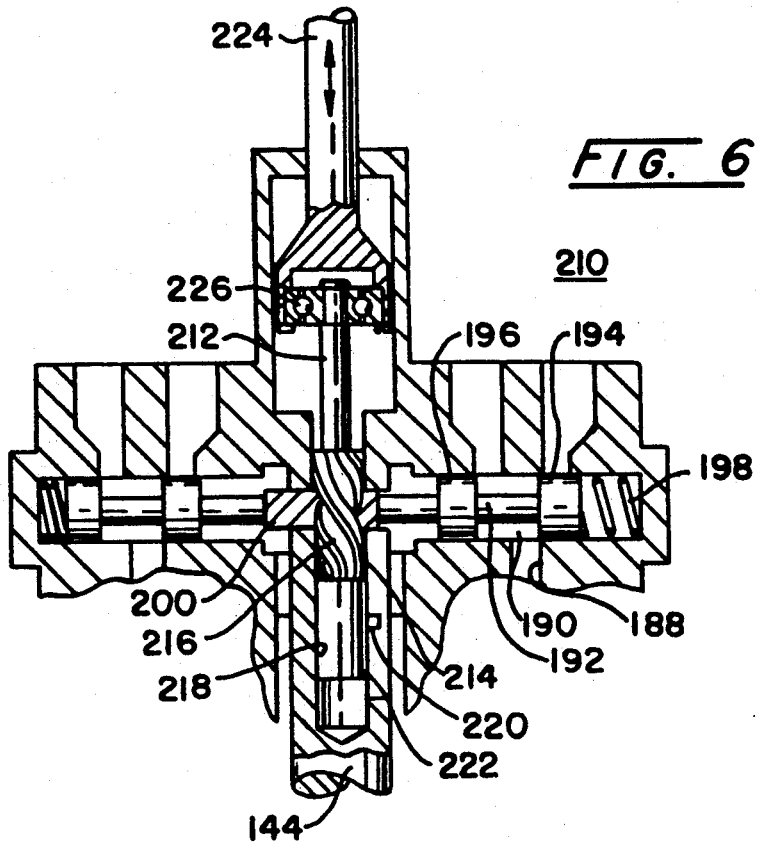
FIG. 6 is a cross sectional view of an adjustable slide valve assembly adapted to be utilized in conjunction with the slide valve assembly illustrated in connection with the embodiment illustrated in FIG. 4.

Port block (128) contains a circular fluid supply port (184) and a circular fluid exhaust port (186) which connect to each cylinder port (188) through a slide valve assembly (190) adjacent each cylinder port (188). A pressure fluid port (202) supplies pressure fluid to circular fluid supply port (184) and a tank port (204) connects circular fluid exhaust port (186) to tank. Each slide valve assembly (190) includes a spool (192) having a pair of lands (194 and 196). Spool (192) may be moved to a position in which land (194) blocks fluid supply port (184) and land (196) uncovers fluid exhaust port (186) or to an alternate position in which land (196) blocks fluid exhaust port (186) and land (194) is moved to uncover fluid supply port (184). Each slide valve assembly (190) further includes a spring (198) which acts to bias spool (192) into contact with a cam (200) affixed to the outer end of angle shaft (144). Referring to FIG. 5, it may be seen that rotation of angle shaft (144) and cam (200) causes the spool (192) in each slide valve assembly (190) to reciprocate so as to sequentially supply pressure fluid to cylinder bores (126) through cylinder ports (188) to cause the piston and rod assemblies (134 and 138) to move downwardly and to sequentially connect the cylinder bores (126) containing spent fluid to the fluid exhaust ports (186). As the piston and rod assemblies (134 and 138) are sequentially moved downwardly and upwardly within the bores (126), the nutator assembly (142) nutates about the angle shaft (144). Meshing of bevel gears (170 and 174) prevents rotation of nutator assembly (142) but results in rotation of shaft gear (176) and output shaft (130) as described above. It should be noted that the slide valve assemblies (190) in FIG. 4 are 90 degrees out of phase inasmuch as both of the piston and connecting rod assemblies (134 and 138) are shown at their extreme positions and the spools (192) in each of the slide valve assemblies (190) for those cylinders would be moved to a crossover position in which both ports are blocked.

The direction of rotation and the torque output of the high torque low speed motor (120) may be set by a manual control device (210) adapted to be utilized with the slide valves (190). Manual control device (210) adjusts the torque output and direction of rotation of the motor (120) by changing the angular position of cam (200) with respect to angle shaft (144) and which is driven by angle shaft (144). However, when the manual control device (210) is utilized cam (200) is not affixed directly to angle shaft (144). Instead, cam (200) is driven by shaft (144) through a control shaft (212) having a spiral splined central section (214) which passes through a mating spiral splined bore formed in cam (200). Control shaft (212) is concentric with and resides within an internal bore (218) formed in angle shaft (144). Shaft (144) drives control shaft (212) through a fixed pin (220) which is rigidly attached to the shaft (144) and resides within a longitudinal slot (222) in the control shaft (212). A control handle (224) attaches to the outer end of control shaft (212) through a bearing set (226). The bearing set (226) allows the control shaft (212) to rotate with respect to the control handle (224). The angular position of cam (200) is set by moving the control handle (224) up or down to thereby cause the cam (200) to rotate through the splined connection with shaft (212). Because the axial position of control handle (224) rotates the cam (200) with respect to the slide valve assemblies (190) such movement will change the torque output and direction of rotation of the high torque low speed motor (120).

Figure 8:
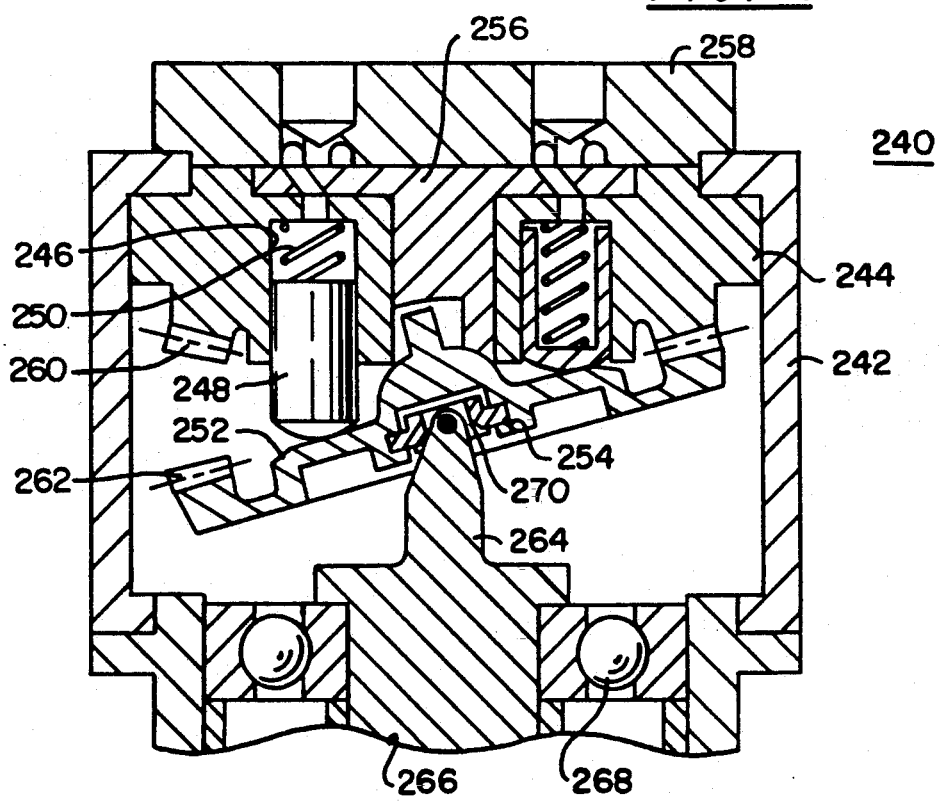
FIG. 8 is a cross sectional view of a fourth embodiment of the present invention.

It may be recalled that the high torque low speed motor of the present invention as described above utilizes a nutator assembly having a bevel gear and an angle gear which mesh respectively with a fixed bevel gear and a rotatable shaft gear to thereby rotate the shaft gear when the assembly is nutated. While the principle advantage to this construction resides in the fact that it provides a convenient connection between the fluid motor and the output shaft, it has been theorized that the geared connection between the nutator assembly and the output shaft may be replaced by a universal joint. A constant velocity type universal joint is preferred. With this construction, the bevel gear on the nutator assembly and the fixed bevel gear would have different numbers of teeth to provide the required differential action for rotation of the output shaft. Such an embodiment of a high torque low speed motor may be seen by referring to FIG. 8 where the device is labeled number 240.

This device includes a housing (242) having a fixed barrel element (244) mounted in one end thereof. Barrel (244) contains a plurality of circumferentially spaced axial piston bores (246) each containing a hollow piston element or actuator (248). These devices are biased by a spring (250) acting to move the pistons into contact with a reaction surface (252) formed on a nutator assembly (254). Nutator assembly (254) drives a rotating valve plate (256) sandwiched between the end of barrel (244) and a port block (258) in the same manner as described in connection with the embodiment depicted in FIG. 7. Accordingly, further explanation of the fluid actuation of the pistons (248) will be deemed unnecessary in view of the previous description.

A downwardly facing bevel gear (260) is rigidly affixed to the outer end of barrel (244). Nutator assembly (254) mounts an upwardly facing bevel gear (262) adapted to mesh with the bevel gear (260). In this embodiment of the invention, it is necessary that the bevel gears (260 and 262) have unequal numbers of teeth. Nutator assembly (254) is mounted on a projecting section (264) of an output shaft (266) supported in bearings (268) in housing (242). Nutator assembly (254) connects drivingly to output shaft (266) through a universal joint assembly (270). Such a joint becomes necessary to ensure rotation of the output shaft (266) as nutator assembly (254) nutates about the outer end of projecting shaft section (264). During the time nutator assembly (254) nutates about the outer end of shaft section (264), bevel gear (262) remains in mesh with the fixed bevel gear (260). However, because the number of teeth on these two gears are unequal, output shaft (264) will rotate angularly by the difference in the number of teeth on the two gears (260 and 262). Although not shown, a thrust surface could be provided within the housing (242) to limit the clamping force between the bevel gears (260 and 262). It may be seen that the motor (240) depicted in FIG. 8 allows the output shaft (266) to freewheel with respect to the actuator pistons (248) inasmuch as the nutator assembly (254) may be pivoted to a horizontal position as described previously in connection with the embodiment of FIG. 7.

From the above, it may be observed that the present invention provides a high torque low speed motor which may be driven by fluid or electrical actuators to cause a nutating assembly to provide a high torque gear reduction drive for an output shaft. The controls for the device may be manually actuated or controlled by a computer. Because the gears utilized in the device are nearly concentric, the device may have a small profile and the nutating action provides a relatively low rotating inertia.

Since certain changes may be made to the above-described structure and method without departing from the scope of the invention herein it is intended that all matter contained in the description thereof or shown in the accompanying drawings shall be interpreted as illustrative and not in a limiting sense.

We claim:

1. A high torque fluid motor which comprises: a housing; a plurality of cylinder bores formed in said housing; an angle shaft having an offset portion rotatably mounted within said housing; a nutator assembly rotatably mounted on said offset portion of said angle shaft; a reaction surface formed on said nutator assembly; a plurality of pistons mounted in said cylinder bores and pivotally affixed to said reaction surface; a first bevel gear affixed to said housing; a second bevel gear mounted on said nutator assembly which meshes with said first bevel gear; an angle gear affixed to said nutator assembly; an output shaft rotatably mounted in said housing having a shaft gear which meshes with said angle gear; a fluid inlet port; a fluid exhaust port; valve means for directing fluid from said inlet port to said cylinders and from said cylinders to said outlet port to cause said pistons to be biased sequentially against said reaction surface to force said nutator assembly to nutate and cause said shaft gear and output shaft to rotate.

2. The high torque motor of claim 1 further comprising: connecting means for connecting said angle shaft to said valve means.

3. The high torque motor of claim 2 in which said connecting means includes a rotary cam on said angle shaft which engages a cam surface on said valve means.

4. The fluid motor of claim 1 in which the number of teeth of said first bevel gear is equal to the number teeth on said second bevel gear to thereby prevent rotation of said second bevel gear and wherein said output shaft rotates an amount equal to the difference in the number teeth of said angle gear and said shaft gear.

5. The fluid motor of claim 1 in which said angle gear has a larger diameter and a greater number of teeth than said shaft gear.

6. The fluid motor of claim 1 in which said angle gear and said second bevel gear on said nutator assembly face the same direction.

7. The fluid motor of claim 1 further comprising: slide valve assemblies interposed between each cylinder port and said fluid inlet and said fluid exhaust port and slideable between a first position in which said fluid inlet port connects to said cylinder port and a second position in which said fluid exhaust port connects to said cylinder port, and a cam at one end of said angle shaft which engages each of said slide valve assemblies wherein rotation of said angle shaft causes said cam to actuate said slide valve assemblies to sequentially supply and exhaust pressure fluid from said cylinder ports.

8. The fluid motor of claim 7 further comprising: an opening formed in one end of said angle shaft; an axially movable spirally splined shaft received in said opening; a slot formed in said shaft; a guide member received in said slot and affixed to said shaft to prevent rotational movement between said angle shaft and said splined shaft; a splined bore formed in said cam which receives said splined shaft; wherein axial movement of said splined shaft causes said cam to rotate relative to said angle shaft to change the timing of said slide valve assemblies to thereby control the direction of rotation of said nutator assembly and output shaft.

* * * * *